US008249490B2

(12) United States Patent
Takahashi

(10) Patent No.: US 8,249,490 B2
(45) Date of Patent: Aug. 21, 2012

(54) IMAGE TRANSFER DEVICE AND IMAGE FORMING APPARATUS

(75) Inventor: Koji Takahashi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 699 days.

(21) Appl. No.: 12/207,281

(22) Filed: Sep. 9, 2008

(65) Prior Publication Data

US 2009/0074483 A1 Mar. 19, 2009

Related U.S. Application Data

(60) Provisional application No. 60/972,464, filed on Sep. 14, 2007.

(51) Int. Cl.
*G03G 15/20* (2006.01)

(52) U.S. Cl. ..... 399/313; 399/314

(58) Field of Classification Search ..... 399/313, 399/314

See application file for complete search history.

(56) References Cited

U.S. PATENT DOCUMENTS 3,877,416 A * 4/1975 Donohue et al. ..... 399/44
4,415,254 A * 11/1983 Nishikawa ..... 399/171
2001/0010766 A1* 8/2001 Kashihara ..... 399/89
2004/0228659 A1* 11/2004 Nishida ..... 399/176
2005/0095437 A1* 5/2005 Furuya et al. ..... 428/423.1

FOREIGN PATENT DOCUMENTS

JP 06-138784 5/1994
JP 2000-116641 4/2000
JP 2006-235218 9/2006

OTHER PUBLICATIONS

Japanese Office Action for Japanese Application No. 2008-232337 mailed on Mar. 13, 2012.

* cited by examiner

*Primary Examiner* — Walter L Lindsay, Jr.
*Assistant Examiner* — Rodney Bonnette
(74) *Attorney, Agent, or Firm* — Turocy & Watson, LLP

(57) ABSTRACT

An image transfer device according to the present invention applies a transfer bias voltage to a toner image developed on a surface of an image carrying member, the transfer bias voltage having an opposite polarity from the polarity of an electric charge of the toner image, by a transfer roller from a power supply device, and electrostatically transfers the toner image to a transfer medium. A resistance element is connected between the power supply device and the transfer roller in series. The resistance element has a value of resistance which varies little with environmental variation, and a ratio between the value of resistance and a synthetic value of resistance of a transfer device including the conductive roller is set to a value which restrains variations in transfer efficiency of the electrostatic transfer with respect to variations in the synthetic value of resistance with the environmental variations.

7 Claims, 6 Drawing Sheets

IMAGE TRANSFER DEVICE AND IMAGE FORMING APPARATUS

CROSS-REFERENCE TO RELATED APPLICATION

This application is based upon and claims the benefit of priority from U.S. provisional Application Ser. No. 60/972,464, filed on Sep. 14, 2007, the entire contents of which are incorporated herein by reference.

TECHNICAL FIELD

The present invention relates to an image transfer device which is able to electrostatically transfer a toner image efficiently to a transfer medium and in which an image quality is stabilized, and an image forming apparatus having the image transfer device.

BACKGROUND

The image forming apparatus of an electrophotographic type such as copying machines or laser printers forms a toner image according to image information on a photoconductive drum, transfers the same on a transfer medium, and finally forms an image on a sheet of paper as a printing object. For example, a laser beam printer forms an electrostatic latent image by charging the surface of the photoconductive drum to a predetermined background potential, and then exposing the surface of the photoconductive drum with a laser beam modulated by the image information. The electrostatic latent image is developed by toner to form a toner image, and the toner image is transferred to a transfer medium.

There are two such image forming methods as shown below. In other words, there are a method of transferring a toner image directly from the photoconductive drum to a sheet of paper as a printing object, which is a final transfer medium, and a method of primarily transferring a toner image on an intermediate transfer belt of an endless film shape, which is used as an intermediate transfer medium, from the photoconductive drum and then secondarily transferring the same to a sheet of paper as the printing object, which is the final transfer medium.

The method of transferring using the intermediate transfer belt from these two methods is employed for forming a full color image, which requires overlapping of toner images in plurality of colors.

In both the transfer methods described above, a transfer roller for transferring the toner image to the intermediate transfer belt or the sheet of paper as the printing object (hereinafter, referred generally to as transfer medium). The transfer roller is arranged at a position opposing the photoconductive drum with the intermediary of the transfer medium, and electrostatically transfers the toner image to the surface of the transfer medium by providing an electric charge having an opposite polarity from the polarity of an electric charge of the toner to the back surface of the transfer medium. In other words, when the polarity of the charge of the toner is minus (−), a transfer bias of plus (+) is applied to the transfer roller to achieve the electrostatic transfer.

Factors which affect on the electrostatic transfer of the toner image as described above include environmental factors such as the temperature or the humidity. In general, a value of resistance of the transfer roller increases under a low-temperature and low-moisture environment, and the value of resistance of the transfer roller is lowered under a high-temperature and high-moisture environment. It is the same for the value of resistance of the transfer medium. When these environmental factors vary, a sufficient transfer electric field cannot be generated between the toner image and the transfer medium even though the same transfer bias is applied, so that deterioration of the transfer efficiency is resulted.

In order to solve the problem as described above, the apparatus disclosed in Japanese Unexamined Patent Application Publication No. JP-A-2000-116641 uses an environmental sensor, and employs a control system to measure the values of resistance of a conductive roller in each environmental condition and achieve an optimal voltage setting at a printing unit by controlling the applied voltage on the basis of a measured value of resistance. However, such control requires a control device having various sensors and storage devices, which results in complication of the apparatus and cost increase.

With means for measuring the resistance of the conductive roller employing a control system to output a predetermined current in a resistance sensing process, calculate the resistance from a measured value of applied voltage and achieve the optimal voltage setting at the printing unit, avoidance of the complication of the apparatus and the cost increase described above is possible. However, there is a case where a stabilized transfer efficiency cannot be obtained in various environments from the reasons shown below.

In the case of a color transfer, since the toners in a plurality of colors are transferred in an overlapped manner as described above, the percentage occupied by a value of toner resistance is increased in an environment in which the value of resistance of the conductive roller remarkably drops. Therefore, the optimal voltage setting varies depending on the thickness of a transferred toner layer, and hence the transfer efficiency may vary depending on the attached amount of toner.

In addition, when forming a full color image, it is necessary to consider a problem of reverse transfer due to a white background inrush current. In other words, when forming the full color image, the toner images are transferred from photoconductive members to the intermediate transfer belt at respective transfer positions for yellow, magenta, cyan, and black in sequence. However, toner in a specific color is not used depending on the image. For example, when black toner is not used, and hence the black toner is not present on the photoconductive drum at a minus potential, if a plus potential is applied from the transfer roller at the transfer position for black, a significant inrush current flows because there is no toner, which is a high resistance material. When such an inrush current flows, toner which is transferred to the intermediate transfer belt already in the upstream transfer devices for yellow, magenta, and cyan and is already charged in minus is inverted into a straight polarity, so that an inverted transfer phenomenon in which the toner is adhered to the photoconductive drum from the intermediate transfer belt occurs. When occurrence of such a reverse transfer is prominence, a defective color balance may occur in an output image. Therefore, a countermeasure for the white background inrush current is necessary.

SUMMARY

It is an object of the present invention is to provide an image transfer device and an image forming apparatus which are able to obtain a stabilized high transfer efficiency without being affected by variations in resistance at a transfer device, which is caused by environmental variations.

According to an embodiment of the present invention, an image transfer device includes: an image carrying member having a surface charged at a predetermined potential; a latent image forming device that forms an electrostatic latent image on the surface of the image carrying member; a developing device that develops a toner image on the electrostatic latent image formed on the surface of the image carrying member; a transfer roller that comes into contact with the toner image developed on the image carrying member via a transfer medium and applies a voltage having an opposite polarity from the polarity of an electric charge of the toner image to electrostatically transfer the toner image on the transfer medium; a power supply device that applies a transfer bias voltage to the transfer roller; and a resistance element connected between a voltage generating portion of the power supply device and the transfer roller in series.

DETAILED DESCRIPTION

Referring now to the attached drawings, an embodiment of the present invention will be described in detail.

Figure 1:
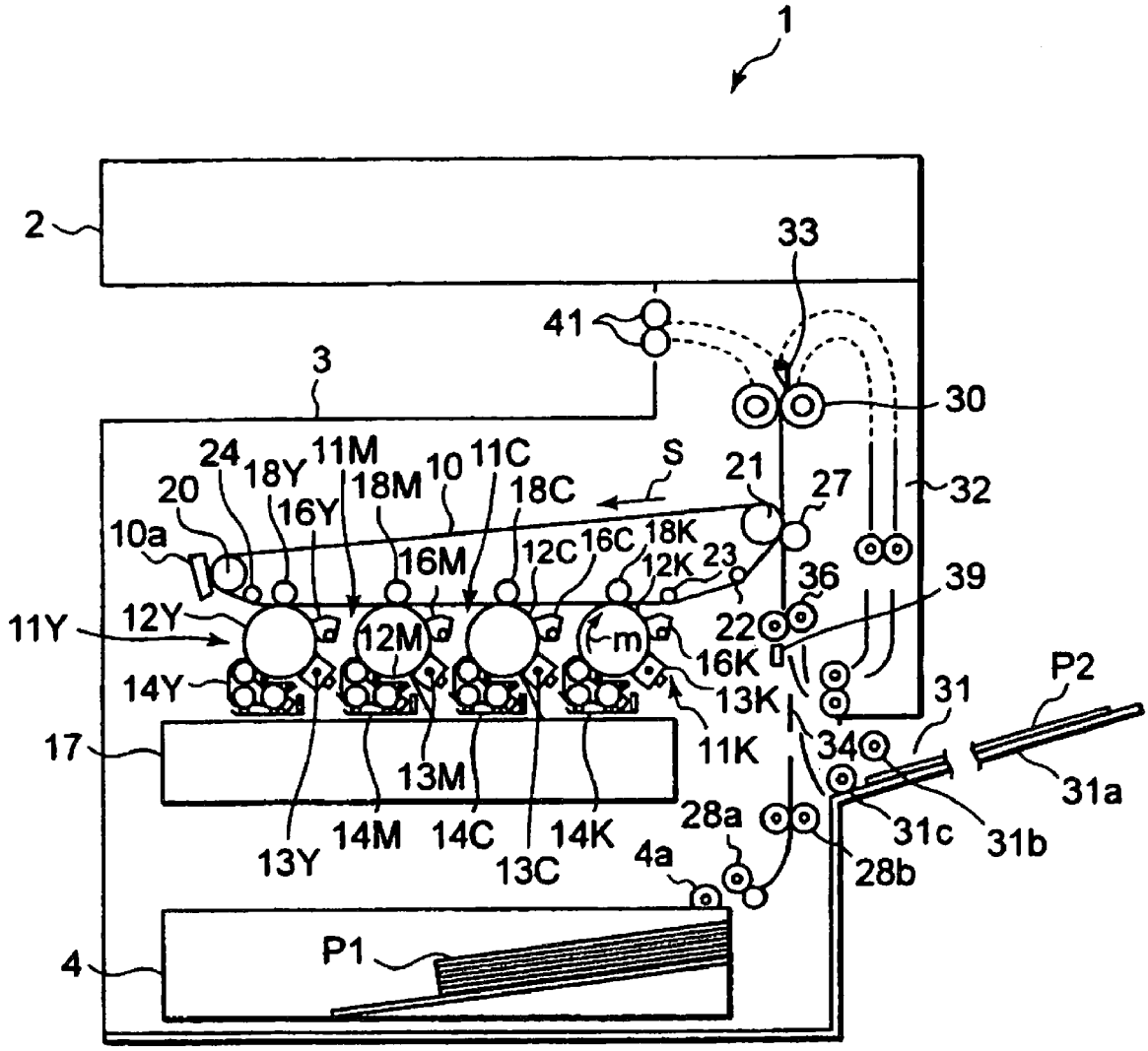
FIG. 1 is a configuration drawing schematically showing an image forming apparatus in a first embodiment of the present invention.

FIG. 1 is a schematic configuration drawing showing a quadruple tandem-system color copying machine 1 as an image forming apparatus in the embodiment of the present invention. The color copying machine 1 includes a scanner unit 2 and a paper discharge unit 3 on the upper portion thereof. The color copying machine 1 includes a set of four image forming stations 11Y, 11M, 11C and 11K for yellow (Y), magenta (M), cyan (C), and black (K) arranged in parallel along a lower side of an intermediate transfer belt (intermediate transfer medium) 10.

The image forming stations 11Y, 11M, 1C, and 11K include photoconductive drums (image carrying member) 12Y, 12M, 12C, and 12K, respectively. Electric chargers 13Y, 13M, 13C, and 13K, developing devices 14Y, 14M, 14C, and 14K, and photoconductive cleaning devices 16Y, 16M, 16C, and 16K are arranged around the photoconductive drums 12Y, 12M, 12C, and 12K in the direction of rotation indicated by an arrow m. A portion around the photoconductive drums 12Y, 12M, 12C, and 12K from the electric chargers 13Y, 13M, 13C, and 13K to the developing devices 14Y, 14M, 14C, and 14K is irradiated with exposing light by a laser exposing device (latent image forming device) 17, and electrostatic latent images are formed on the photoconductive drums 12Y, 12M, 12C, and 12K.

The developing devices 14Y, 14M, 14C, and 14K have two-component developer including toner in yellow (Y), magenta (M), cyan (C), and black (K) and carrier, respectively, and supply toner to the electrostatic latent images on the photoconductive drums 12Y, 12M, 12C, and 12K.

The intermediate transfer belt 10 is wound around a backup roller 21, a driven roller 20 and first to third tension rollers 22 to 24 with a tension. The intermediate transfer belt 10 opposes the photoconductive drums 12Y, 12M, 12C, and 12K and comes into contact therewith. Primary transfer rollers 18Y, 18M, 18C, and 18K for primarily transferring toner images on the photoconductive drums 12Y, 12M, 12C, and 12K to the intermediate transfer belt 10 are provided at positions on the intermediate transfer belt 10 opposing the photoconductive drums 12Y, 12M, 12C, and 12K. The primary transfer rollers 18Y, 18M, 18C, and 18K are conductive rollers, respectively, and a primarily transfer bias voltage is applied respectively to respective transfer devices.

A secondary transfer roller 27 is arranged on a secondary transfer device as a transfer position of the intermediate transfer belt 10 supported by the backup roller 21. The backup roller 21 at the second transfer device is a conductive roller and a predetermined secondary transfer bias is applied. When a sheet of paper as a printing object (final transfer medium) passes a nip between the intermediate transfer belt 10 and the secondary transfer roller 27, the toner images on the intermediate transfer belt 10 is secondarily transferred to the sheet of paper. After the secondary transfer is ended, a belt cleaner 10*a* cleans the intermediate transfer belt 10.

The laser exposing device 17 includes a paper feed cassette 4 in the lower portion thereof for feeding the sheets of paper toward the secondary transfer roller 27. A manual insertion mechanism 31 for manually feeding the sheet of paper is provided on the right side of the color copying machine 1.

A pickup roller 4*a*, a separation roller 28*a*, a carrier roller 28*b*, and a resist roller pair 36 are provided between the paper feed cassette 4 and the secondary transfer roller 27, which constitute a paper feeding mechanism. A manual insertion pickup roller 31*b* and a manual insertion separation roller 31*c* are provided between the manual insertion tray 31*a* of the manual insertion mechanism 31 and the resist roller pair 36.

A media sensor 39 for sensing the type of the sheet of paper is arranged on a vertical carrier path 34 for carrying a sheet of paper from the paper feed cassette 4 or the manual insertion tray 31*a* toward the secondary transfer roller 27. The color copying machine 1 is able to control carrying velocity, transfer conditions, and fixing conditions or the like from a sensed result by the media sensor 39. A fixing device 30 is provided downstream in the direction of the vertical carrier path 34 with respect to the secondary transfer device.

The sheet of paper taken from the paper feed cassette 4 or fed from the manual insertion mechanism 31 is carried to the fixing device 30 along the vertical carrier path 34 via the resist roller pair 36 and the secondary transfer roller 27. The fixing device 30 fixes the toner image transferred to the sheet of paper by the secondary transfer device by a heat processing. A gate 33 is provided downstream with respect to the fixing device 30, and selectively switches the path between the direction to the paper discharge roller 41 and the direction to the re-carrying unit 32. The sheet of paper guided to a paper discharge roller 41 is discharged to the paper discharge unit 3. The sheet of paper guided to a re-carrying unit 32 is guided toward the secondary transfer roller 27 again.

The image forming station 11Y integrally includes the photoconductive drum 12Y and processing means, and is detachably attached to a main body of the image forming apparatus. The processing means is at least one of the electric charger 13Y, the developing device 14Y and the photoconductive cleaning device 16Y. The image forming stations 11M, 11C and 11K also have the same configuration as the image forming station 11Y. The image forming stations 11Y, 11M, 11C and 11K may be detachably attached to the image forming apparatus, or may be detachably attached to the image forming apparatus as an integral image forming unit 11 independently.

Subsequently, a portion of the image transfer device in the image forming apparatus will be described. The image transfer device corresponds to the transfer devices of the image forming stations 11Y, 11M, 11C and 11K (hereinafter, the suffix of Y, M, C, and K, including other related components, are omitted).

Figure 2:
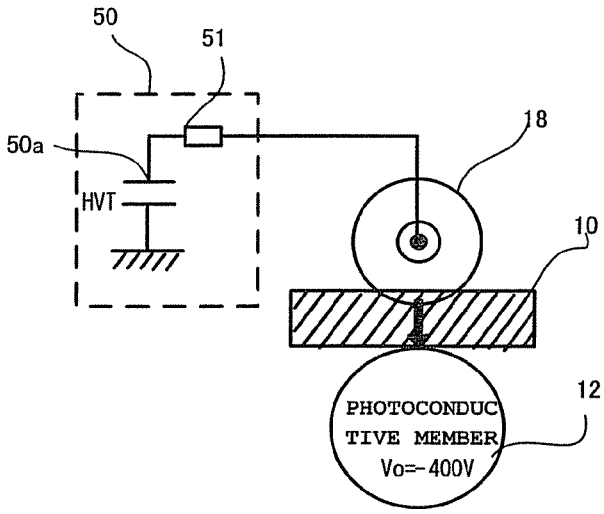
FIG. 2 is a configuration drawing showing an image transfer device in the first embodiment of the present invention.

In other words, the image transfer device includes the photoconductive drum 12, as an image carrying member shown in FIG. 1, the laser exposing device 17 as a latent image forming device, the developing device 14, and the primary transfer roller (conductive roller) 18, and further includes a power supply device 50 and a resistance element 51 as shown in FIG. 2. These components serve to transfer the toner image on the intermediate transfer belt 10 as the transfer medium.

The electric charger 13 charges the surface of the photoconductive drum 12 to a predetermined potential, for example, −400 v. The laser exposing device 17 forms the electrostatic latent image on the surface of the photoconductive drum 12. The developing device 14 develops the toner image on the electrostatic latent image formed on the surface of the photoconductive drum 12. The primary transfer roller 18 comes into contact with the toner image developed on the surface of the photoconductive drum 12 via the intermediate transfer belt 10 as shown in FIG. 2, and applies a voltage having an opposite polarity from the polarity of the electric charge of the toner image to electrostatically transfer the toner image on the intermediate transfer belt 10.

The power supply device 50 supplies a transfer bias voltage to the primary transfer roller 18, includes a voltage generating unit 50*a*, and generates the transfer bias voltage which may be set as desired. The power supply device 50 includes a constant current control unit and a constant voltage control unit, although not shown, as basic functions. The constant current control unit controls the constant current of +15 μA before a transferring operation, then senses the voltage applied at this time to obtain a synthetic value of resistance of the transfer device from the applied voltage, and then determines a constant voltage output at the time of transfer. The constant voltage control unit controls to output a determined constant transfer bias voltage.

The resistance element 51 is connected between the voltage generating unit 50*a* of the power supply device 50 and the primary transfer roller 18 as the conductive roller in series. The value of resistance of the resistance element 51 varies little with environmental variations such as variations in temperature or moisture. The value of resistance of the resistance element 51 is set to a value which restrains the transfer efficiency of the electrostatic transfer from varying with variations in the synthetic value of resistance of the transfer device connected to the resistance element 51 in series with the environmental variations.

In other words, in the transfer device connected to the resistance element 51 in series, since the primary transfer roller 18 is a conductive roller formed of a material obtained by dispersing ionic conductive material in polymer, the value of resistance varies significantly with the environmental variations such as the variations in temperature or moisture. Since the intermediate transfer belt is formed basically of polyimide, the value of resistance thereof varies with the environmental variations such as the variations in temperature or moisture, although not as much as the primary transfer roller 18. Therefore, when the resistance element 51 is not present, the value of resistance of the primary transfer roller 18 or the intermediate transfer belt 10 significantly varies when the power supply device 50 applies the constant voltage thereto, whereby the transfer efficiency significantly varies and the stabilized transfer is difficult to achieve.

In the present invention, the resistance element 51 is connected to the primary transfer roller 18 and the intermediate transfer belt 10 in series, so that the transfer efficiency is not affected even when the value of resistance of the primary transfer roller 18 or the intermediate transfer belt 10 varies.

In this case, the larger the percentage of the value of resistance of the resistance element 51 with respect to the synthetic value of resistance of the transfer device to be connected to the resistance element 51 in series (the primary transfer roller 18, the intermediate transfer belt 10, toner, and photoconductive drum 12) is, the less the affect of variations in synthetic value of resistance on the transfer efficiency becomes. However, when the value of resistance increases, a higher voltage is required for allowing a current required for transfer to flow, and the output voltage of the power supply device 50 must be increased correspondingly.

From such circumstances, the specific value of resistance of the resistance element 51 is set as shown below. Assuming that the value of resistance R0 of the resistance element 51 is 1.0, the relation between the value of resistance R0=1 of its own and the range of resistance between a minimum value and a maximum value of the synthetic value of resistance R of the transfer device connected to the resistance element 51 in series on the basis of the environmental variations is set as follows;

$$0.4 \leqq R \leqq 6.0.$$

Here, the synthetic value of resistance of the transfer device (the primary transfer roller 18, the intermediate transfer belt 10, toner, the photoconductive drum 12) connected to the resistance element 51 in series (hereinafter, referred to as synthetic value of resistance in primary transfer) was 4.33E+07 (43.25 MΩ) under a high-temperature and high-moisture (for example, 40° C., 90%) environment, and 1.69E+08 (169.02 MΩ) under a low-temperature and low-moisture (for example, 10° C., 30%) environment when measured with an actual device possessed by the applicant. These values are values obtained from standard products applied to the actual device, and may vary depending on the each actual device. On the basis of these values, the minimum synthetic value of resistance in primary transfer on the basis of the environmental variations in temperature and moisture was set to 2.00E+07(20 MΩ) and the maximum synthetic value of resistance in primary transfer of the same was set to 3.00E+08(300 MΩ).

Figure 3:
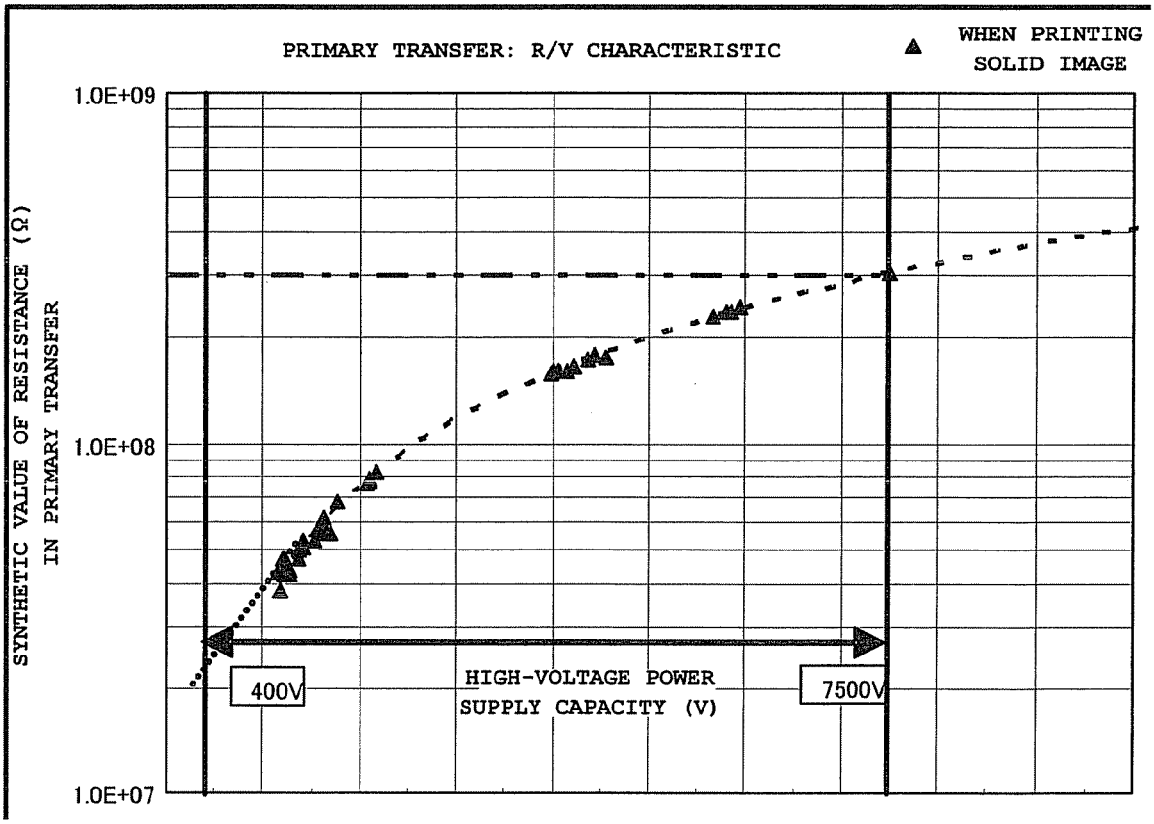
FIG. 3 is a characteristic chart showing a correlation between a primary transfer voltage and a synthetic value of resistance in primary transfer in the first embodiment of the present invention.

The minimum and maximum synthetic values of resistance in primary transfer described above were determined as follows in association with the specification of the power supply device 50. FIG. 3 shows a correlation between the primary transfer voltage and the synthetic value of resistance in primary transfer. When the apparatus is used with a synthetic value of resistance in primary transfer of 20 MΩ without the resistance element 51 under the high-temperature and high moisture environment, the bias voltage to be applied to the primary transfer roller 18 for obtaining a total current required for the toner transfer was on the order of 400 V as shown in FIG. 3. In general, provision of the power supply device in which the difference between the maximum output voltage and the minimum output voltage significantly exceeds 7 kv is difficult in terms of cost. Therefore, the value of resistance of 20 MΩ, whose lowest limit value was 400 V, was set as the minimum synthetic value of resistance in primary transfer.

On the other hand, when the apparatus is used with a synthetic value of resistance in primary transfer of 300 MΩ without the resistance element 51 under the low-temperature and low-moisture environment, the bias voltage to be applied to the primary transfer roller 18 for obtaining the total current required for toner transfer is on the order of 7 KV as shown in FIG. 3. Actually, since the apparatus is used in a state in which the value of resistance of the resistance element 51 is added, the bias voltage is on the order of 7.5 KV. Provision of the power supply device which obtains the output of 10 KV with a high-voltage power source for general copying machine is difficult in terms of cost. Therefore, the synthetic value of resistance of 300 MΩ, whose highest limit value was 7.5 KV bias, was set as the maximum synthetic value of resistance in primary transfer.

Assuming that the value of resistance of the resistance element 51 is 50 MΩ, a ratio of resistance with respect to the range of resistance of the synthetic value of resistance in primary transfer which varies with the environment (minimum value=20 MΩ, maximum value=300 MΩ) is $0.4 \leqq R \leqq 6.0$, where the value of resistance of the resistance element 51 is R0=1.0. In other words, when the minimum synthetic value of resistance in primary transfer=20 MΩ, and the maximum synthetic value of resistance in primary transfer=300 MΩ, the value of the resistance element 51 is 50 MΩ on the basis of the ratio of resistance described above.

Figure 4:
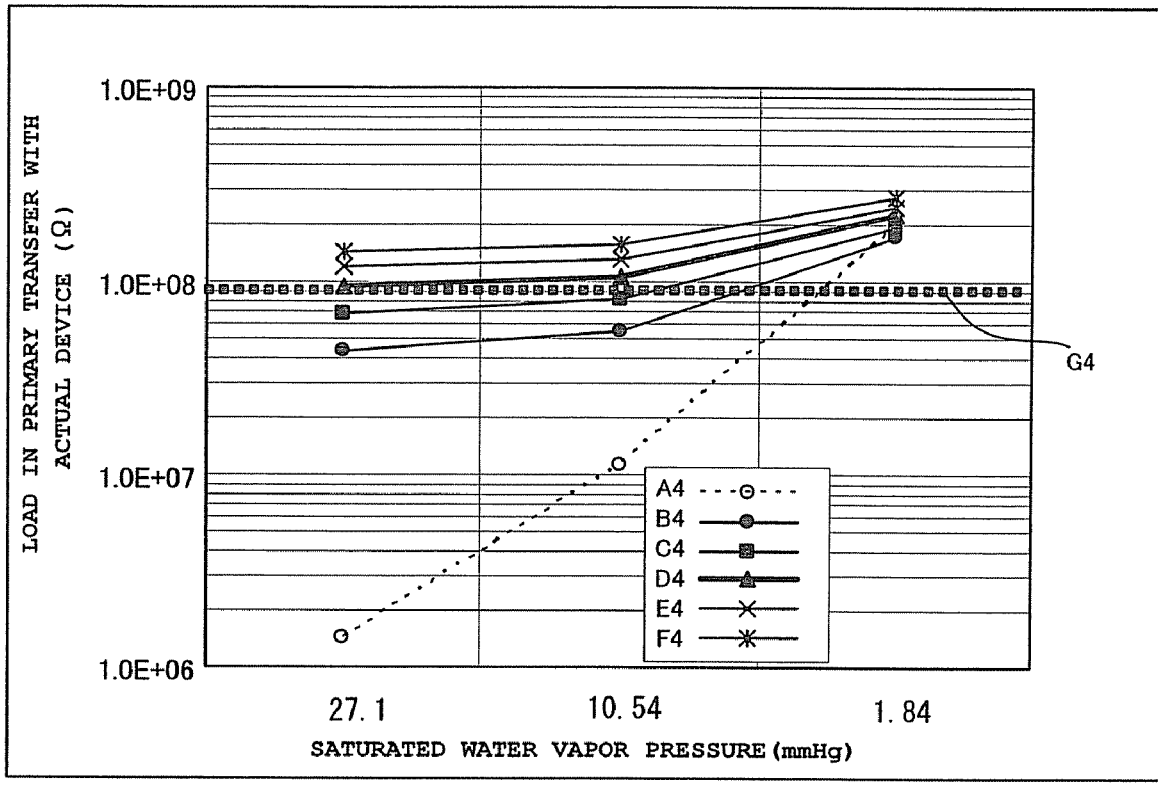
FIG. 4 is a characteristic chart showing variations in value of resistance (load on actual device in primary transfer) of the primary transfer device with respect to the environmental variation in the first embodiment of the present invention.

FIG. 4 shows variations in value of resistance (load on the actual device in primary transfer) with respect to the environmental variations of the primary transfer device shown in FIG. 2.

A line A4 represents a variation in resistance of the single primary transfer roller 18. In association with transition from the high-temperature and high-moisture environment to the low-temperature and low-moisture environment, the value of resistance dramatically increases as shown in the chart.

A line B4 represents a variation in synthetic resistance of the primary transfer roller 18, the intermediate transfer belt 10, and the photoconductive drum 12. As described before, the results were 4.33E+07 (43.25 MΩ) under a high-temperature and high-moisture environment, and 1.69E+08 (169.02 MΩ) under a low-temperature and low-moisture environment. In this manner, when the values of resistance of the intermediate transfer belt 10 and the photoconductive drum 12 are added to that of the primary transfer roller 18, the value of resistance in the high-temperature and high-moisture environment increases, and the difference on the side of the low-temperature and low-moisture is decreased. However, in this state, variations in transfer efficiency caused by the environmental variations occur.

A line C4 represents variations in a load Ω on the actual device in primary transfer in a case where 25 MΩ is added as the resistance element 51, a line D4 represents a case where 50 MΩ is added, a line E4 represents a case where 75 MΩ is added, and a line F4 represents a case where 100 MΩ is added, respectively.

A line G4 represents a lower limit value of the load on actual device in primary transfer which allows improvement of the transfer efficiency, and if the load on actual device in primary transfer is increased to the line G4 (9.00E+07Ω) or higher, it means that the transfer efficiency is improved. The higher the value of resistance of the resistance element 51 is, the larger the effect of improvement of the transfer efficiency becomes. However, the power supply device 50 must generate a high voltage correspondingly, so that it is not practical as the power supply device for the copying machine, and adding the resistance element 51 of 50 MΩ obtained in the manner described above is sufficient.

In this manner, with the provision of the resistance element 51 having a predetermined value of resistance between the voltage generating unit 50*a* of the power supply device 50 and the transfer device including the primary transfer roller 18, significant drop of the transfer efficiency is avoided even when the environmental variations such as temperature or moisture occur, so that stabilized good transfer efficiency is obtained. With addition of the resistance element 51, the white background inrush current is restrained, so that the effect to restrain the reverse transfer caused by the white background inrush current is achieved.

Figure 5:
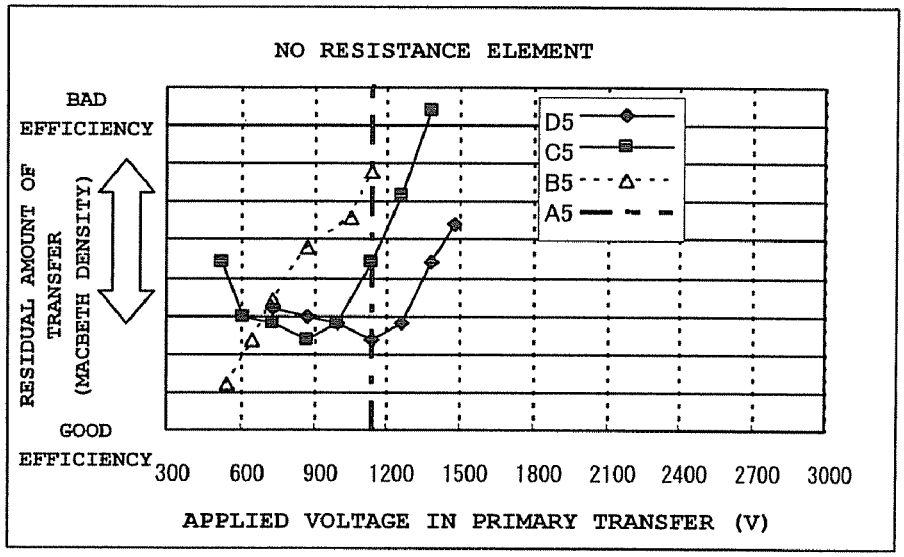
FIG. 5 is a characteristic chart showing a relation between a transfer characteristic and a toner-attachment amount dependency at a transfer device when a resistance element is not provided in the first embodiment of the present invention.
Figure 6:
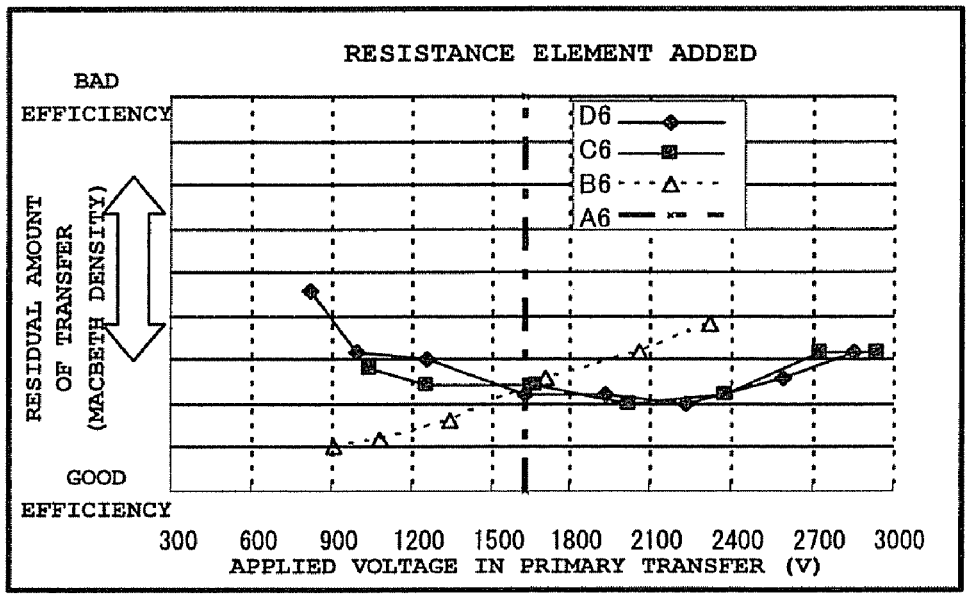
FIG. 6 is a characteristic chart showing a relation between the transfer characteristic and the toner-attachment amount dependency at the transfer device when the resistance element is provided in the first embodiment of the present invention.

FIG. 5 and FIG. 6 show a relation between transfer characteristic in the transfer device and dependency to the attached amount of toner. FIG. 5 shows a case where the resistance element 51 is not provided, and FIG. 6 shows a case where the resistance element 51 is provided.

In FIG. 5 and FIG. 6, lines A5 and A6 represent voltage values applied from the power supply device 50 to the primary transfer device such as the primary transfer roller 18. Lines B5 and B6 represent an amount of reverse transfer. Lines C5 and C6 represent efficiency in a case where a single layer of the toner image is transferred, and lines D5 and D6 represent efficiency in a case where two layers of the toner images are transferred in an overlapped manner.

When the resistance element 51 is not provided as shown in FIG. 5, the transfer efficiency of the single layer indicated by the line C5 demonstrates a good value at the applied voltage value indicated by the line A5, however, the transfer efficiency of the two overlapped layers indicated by the line D5 is significantly lowered in comparison with the case of the single layer. The amount of reverse transfer indicated by the line B5 increases with increase in applied voltage, and a significant amount of reverse transfer is generated at the applied voltage value indicated by the line A5. In contrast, when the resistance element 51 is provided as in FIG. 6, the applied voltage value indicated by the line A6 is higher than the applied voltage value (A5) in FIG. 5. However the transfer efficiency in the case of the single layer indicated by the line C6 and the transfer efficiency of the two overlapped layer indicated by the line D6 are substantially the same and good values. The amount of the reverse transfer indicated by the line B6 increase with increase in applied voltage. However, the amount of reverse transfer at the applied voltage value indicated by the line A6 is restrained to a small value.

In view of such circumstances, it is understood that the provision of the resistance element 51 is effective also in multi-layer transfer for forming color images, and is also effective for restraining the reverse transfer.

Figure 7:
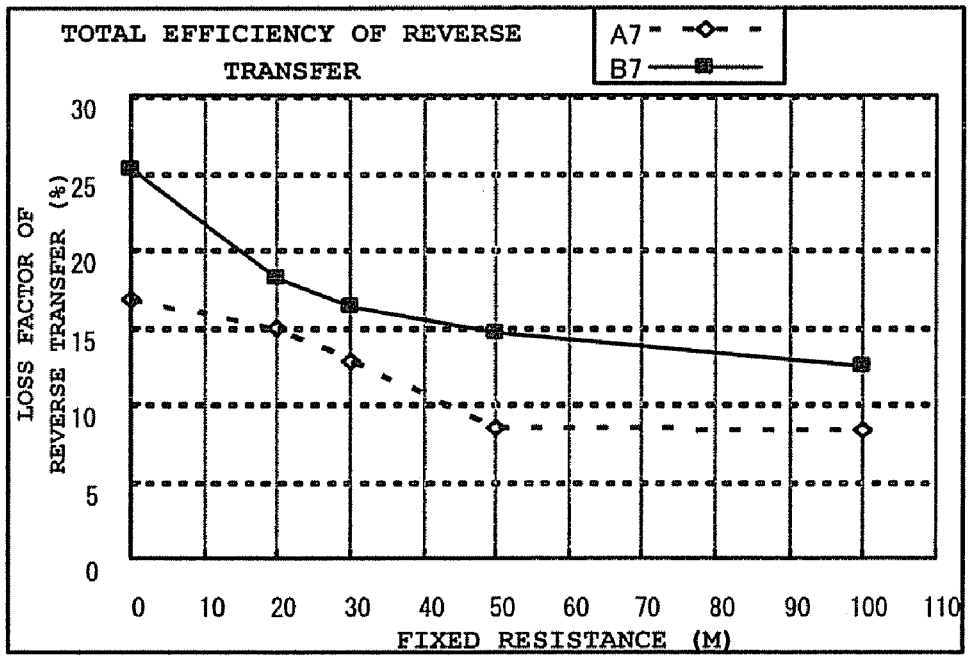
FIG. 7 is a characteristic chart showing a relation between a value of resistance of the resistance element and a ratio of reverse transfer loss in the first embodiment of the present invention.

FIG. 7 shows a relation between the value of resistance of the resistance element 51 and a ratio of reverse transfer loss. The ratio of reverse transfer loss represents how many percent of toner from the toner transferred to the intermediate transfer belt 10 is reversely transferred to the photoconductive drum 12. As a matter of course, the higher the ratio of reverse transfer loss is, the larger the amount of toner to be reversely transferred from the intermediate transfer belt 10 to the photoconductive drum 12 becomes and the lower the transfer efficiency becomes. In FIG. 7, a case where the toner on the intermediate transfer belt 10 is in a single color (a line A7), and a case of two colors overlapped with each other (a line B7) are shown, respectively. The ratio of reverse transfer loss is higher in the case of the two colors overlapped with each other (the line B7) in comparison with the case of the single color (the line A7). In either cases, the ratio of reverse transfer is lowered with increase in value of resistance of the resistance element 51. As is clear from the drawing, in the case of the actual device, when the value of resistance of the resistance element 51 is increased to 50 MΩ, the ratio of reverse transfer loss is remarkably lowered. However, even though the value of resistance is further increased, the ratio of reverse transfer loss is not lowered significantly, and assumes a substantially saturated state.

Figure 8:
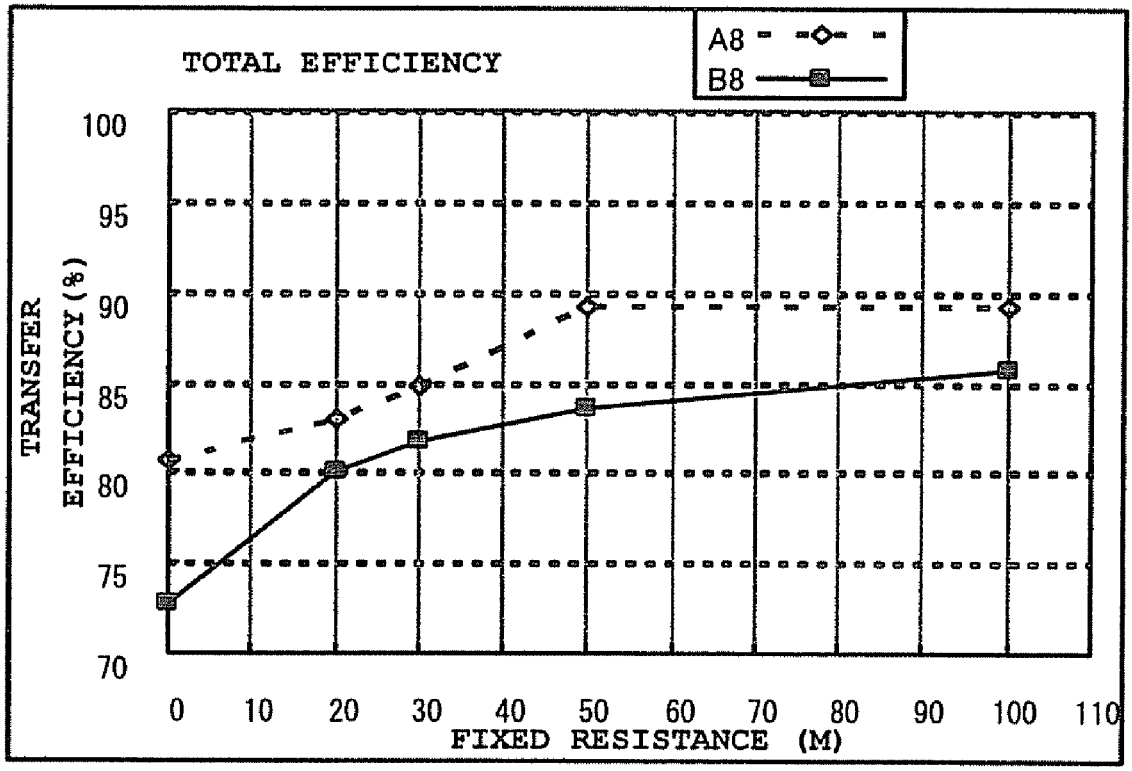
FIG. 8 is a characteristic chart showing a relation between the value of resistance of the resistance element and total transfer efficiency in the first embodiment of the present invention.
Figure 9:
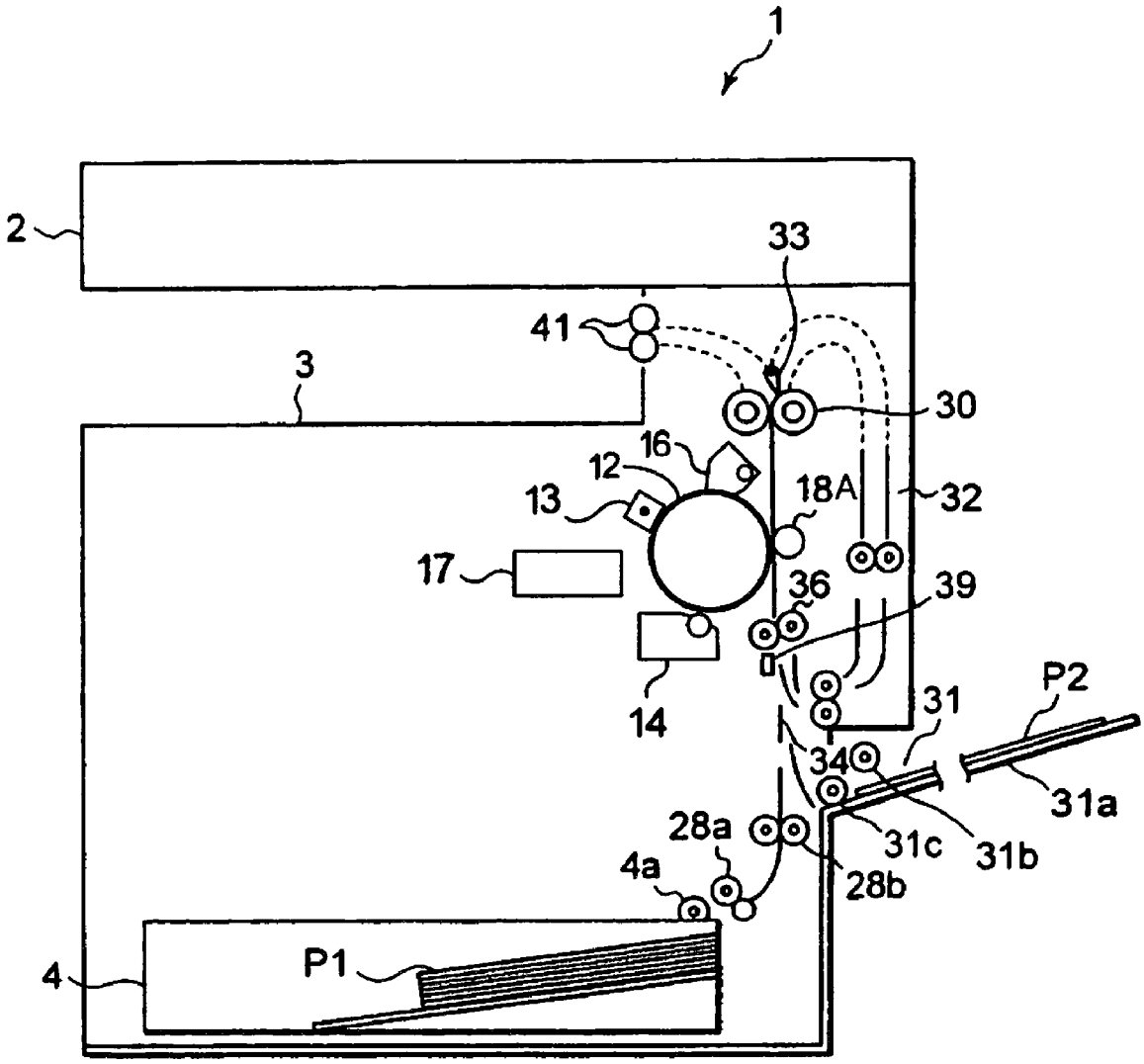
FIG. 9 is a configuration drawing schematically showing an image forming apparatus in a second embodiment of the present invention.

FIG. 8 shows a relation between the value of resistance of the resistance element 51 and total transfer efficiency. The total transfer efficiency represents how much toner on the photoconductive drum 12 is transferred to the intermediate transfer belt 10. In other words, when all the toner on the photoconductive drum 12 is transferred to the intermediate transfer belt 10, the total transfer efficiency is 100%. However, since toner remaining on the photoconductive drum 12 due to various conditions or toner returning back to the photoconductive drum 12 by the reverse transfer as described above may be present, so that the loss occurs, and the total transfer efficiency is lowered. FIG. 8 shows a case where the toner transferred to the intermediate transfer belt 10 is in a single color (the line A8) and a case of two color overlapped with each other (the line B8), respectively. The total transfer efficiency is higher in the case of the single color (the line A8) than the case of the two colors (the line B8) overlapped with each other. In either cases, the total transfer efficiency is improved with increase in value of resistance of the resistance element 51. As is clear from the drawing, in the case of the actual device, when the value of resistance of the resistance element 51 is increased to 50 MΩ, the total transfer efficiency is also remarkably increased. However, even though the value of resistance is further increased, the total transfer efficiency is not increased significantly, and assumes a substantially saturated state.

From these reasons, in the case of the actual device, when the resistance element 51 of 50 MΩ is connected between the voltage generating unit 50*a* of the power supply device 50 and the primary transfer device in series, there is an effect such that the primary transfer from the photoconductive drum 12 to the intermediate transfer belt 10 is stably and efficiently achieved. The value of resistance the resistance element 51 is not limited to 50 MΩ, as a matter of course, and may vary according to the material or configuration of the transfer roller 18, the intermediate transfer belt 10, toner and the photoconductive drum 12 which constitute the primary transfer device. Therefore, as described before, the ratio of the resistance between the range of resistance of the synthetic transfer resistance varying depending on the environment and the value of resistance (R0=1.0) of the resistance element 51 is set to $0.4 \leqq R0 = 1.0 \leqq 6.0$, and the value of resistance obtained from this relation may be determined as the value of resistance of the resistance element 51.

The description described above is based on the case of transferring the toner image formed on the photoconductive drum 12 to the intermediate transfer belt (transfer medium) 10 by the primary transfer roller (conductive roller) 18. However, the invention may also be applied to the case of transferring the toner image transferred to the intermediate transfer belt 10 to the sheet of paper as the final transfer medium. In such a case, the intermediate transfer belt 10 serves as the image carrying member, and the sheet of paper serves as the transfer medium. The values of resistance of the intermediate transfer belt 10, the backup roller 21, the transfer roller 27 which constitute a secondary transfer device, and the sheet of paper as the transfer medium vary depending on the environmental conditions such as the temperature and the moisture.

Here, it is assumed that the power supply device 50 shown in FIG. 2 is used for the secondary transfer device as well, and the transfer bias voltage is applied from the voltage generating unit 50*a* via the resistance element 51.

In this case, the value of resistance of the resistance element 51 is obtained in the same manner as the primary transfer device as described above. In other words, the synthetic resistance of the intermediate transfer belt 10 as the image carrying member, the backup roller 21, the transfer roller 27 and the sheet of paper as the transfer medium, which constitute the secondary transfer device is determined as the synthetic transfer resistance as described above. Then, the ratio of resistance between the range of resistance varying depending on the environment of the transfer synthetic resistance and the value of resistance (R0=1.0) of the resistance element 51 is set to $0.4 \leqq R0 = 11.0 \leqq 6.0$, and the value of resistance obtained from such a relation is determined as the value of resistance of the resistance element 51.

In this configuration, the secondary transfer device is also prevented from being affected by the environmental variation, and the stabilized and good transfer efficiency is obtained.

The power supply device 50 is described as the device which applies the transfer bias voltage to both the primary transfer device and the secondary transfer device. However, members corresponding to the power supply device 50 and the resistance element 51 may be provided independently for the primary transfer device and the secondary transfer device, as a matter of course.

Although the description given above relates to the case of transferring toner in the plurality of colors to the intermediate transfer medium 10 on condition of obtaining color images, the present invention may be applied in the same manner also in the case of transferring the toner in a single color directly to the sheet of paper as the final transfer member without using the intermediate transfer medium 10 as shown in Fig, 9. In this case, the secondary transfer roller 27 in FIG. 1 may become unneeded. Instead, the transfer roller (conductive roller) 18A corresponding to the primary transfer roller (conductive roller) 18 in FIG. 1 may be provided.

What is claimed is:

1. An image transfer device, comprising:

an image carrying member having a surface charged at a predetermined potential;

a latent image forming device that forms an electrostatic latent image on the surface of the image carrying member;

a developing device that develops the electrostatic latent image formed on the surface of the image carrying member to form a toner image;

a transfer section including a conductive roller opposed with the toner image developed on the image carrying member via a transfer medium and applies a voltage having an opposite polarity from the polarity of an electric charge of the toner image to electrostatically transfer the toner image on the transfer medium;

a power supply device that applies a transfer bias voltage to the conductive roller including a voltage generating portion; and a resistance element connected between the voltage generating portion of the power supply device and the conductive roller in series, wherein, assuming that the value of resistance R0 of the resistance element is 1.0, a range of resistance of the synthetic value of resistance R of the transfer section connected to the resistance element in series is set as:

$$0.4 \leqq R \leqq 6.0.$$

2. An image transfer device comprising:

an image carrying member having a surface charged at a predetermined potential;

a latent image forming device that forms an electrostatic latent image on the surface of the image carrying member;

a developing device that develops the electrostatic latent image formed on the surface of the image carrying member to form a toner image;

a transfer section including a conductive roller opposed with the toner image developed on the image carrying member via a transfer medium and applies a voltage having an opposite polarity from the polarity of an electric charge of the toner image to electrostatically transfer the toner image on the transfer medium;

a power supply device that applies a transfer bias voltage to the conductive roller including a voltage generating portion; and a resistance element connected between the voltage generating portion of the power supply device and the conductive roller in series, wherein the power supply device has a maximum output voltage lower than 10 kv and the difference between the maximum output voltage and a minimum output voltage is 7.1 kv or less.

3. An image transfer device comprising:

an image carrying member having a surface to be charged to a predetermined potential;

a latent image forming device that forms an electrostatic latent image on the surface of the image carrying member;

a developing device that develops the electrostatic latent image formed on the surface of the image carrying member to form a toner image;

an intermediate transfer medium;

a primary transfer section including a conductive roller for a primary transfer opposed with the toner image developed on the image carrying member via the intermediate transfer medium and applies a voltage having an opposite polarity from the polarity of an electric charge of the toner image to electrostatically transfer the toner image on the intermediate transfer medium;

a secondary transfer section including a conductive roller for a secondary transfer opposed with the toner image transferred to the intermediate transfer medium via a final transfer medium, and applies a voltage having an opposite polarity from the polarity of an electric charge of the toner image to electrostatically transfer the toner image to the final transfer medium;

a power supply device that applies a transfer bias voltage to either one or both of the conductive roller for the primary transfer and the conductive roller for the secondary transfer including a voltage generating portion; and a resistance element connected between the voltage generating portion of the power supply device and at least one of the conductive rollers for the primary and the secondary transfer in series, wherein, assuming that the value of resistance R0 of the resistance element is 1.0, a range of resistance of the synthetic value of resistance R of the transfer section connected to the resistance element in series is set as:

$$0.4 \leqq R \leqq 6.0.$$

4. An image transfer device comprising:

an image carrying member having a surface to be charged to a predetermined potential;

a latent image forming device that forms an electrostatic latent image on the surface of the image carrying member;

a developing device that develops the electrostatic latent image formed on the surface of the image carrying member to form a toner image;

an intermediate transfer medium;

a primary transfer section including a conductive roller for a primary transfer opposed with the toner image developed on the image carrying member via the intermediate transfer medium and applies a voltage having an opposite polarity from the polarity of an electric charge of the toner image to electrostatically transfer the toner image on the intermediate transfer medium;

a secondary transfer section including a conductive roller for a secondary transfer opposed with the toner image transferred to the intermediate transfer medium via a final transfer medium, and applies a voltage having an opposite polarity from the polarity of an electric charge of the toner image to electrostatically transfer the toner image to the final transfer medium;

a power supply device that applies a transfer bias voltage to either one or both of the conductive roller for the primary transfer and the conductive roller for the secondary transfer including a voltage generating portion; and a resistance element connected between the voltage generating portion of the power supply device and at least one of the conductive rollers for the primary and the secondary transfer in series, wherein the latent image forming device forms latent images in respective colors for forming a color image on the image carrying member, the developing device develops the toner images in colors corresponding to the respective latent images, the conductive roller for the primary transfer electrostatically transfers the developed toner images in the respective colors on the intermediate transfer medium in sequence in an overlapped manner, the value of resistance of the resistance element is set to a value which is able to prevent reverse transfer of toner already transferred to the intermediate transfer medium by restraining an inrush current flowing into the primary transfer section when the toner image has little toner when electrostatically transferring the toner image by the conductive roller for the primary transfer, and wherein, assuming that the calue of resistance R0 of the resistance element is 1.0, a range of resistance of the synthetic value of resistance R of the transfer section connected to the resistance element in series is set as:

$$0.4 \leqq R \leqq 6.0.$$

5. An image transfer device comprising:

an image carrying member having a surface to be charged to a predetermined potential;

a latent image forming device that forms an electrostatic latent image on the surface of the image carrying member;

a developing device that develops the electrostatic latent image formed on the surface of the image carrying member to form a toner image;

an intermediate transfer medium;

a primary transfer section including a conductive roller for a primary transfer opposed with the toner image developed on the image carrying member via the intermediate transfer medium and applies a voltage having an opposite polarity from the polarity of an electric charge of the toner image to electrostatically transfer the toner image on the intermediate transfer medium;

a secondary transfer section including a conductive roller for a secondary transfer opposed with the toner image transferred to the intermediate transfer medium via a final transfer medium, and applies a voltage having an opposite polarity from the polarity of an electric charge of the toner image to electrostatically transfer the toner image to the final transfer medium;

a power supply device that applies a transfer bias voltage to either one or both of the conductive roller for the primary transfer and the conductive roller for the secondary transfer including a voltage generating portion; and a resistance element connected between the voltage generating portion of the power supply device and at least one of the conductive rollers for the primary and the secondary transfer in series, wherein the power supply device has a maximum output voltage lower than 10 kv and a difference between the maximum output voltage and a minimum output voltage is 7.1 kv or less.

6. An image forming apparatus comprising:

an image carrying member having a surface charged at a predetermined potential;

a latent image forming device that forms an electrostatic latent image on the surface of the image carrying member;

a developing device that develops the electrostatic latent image formed on the surface of the image carrying member to form a toner image;

a transfer section including a conductive roller opposed with the toner image developed on the image carrying member via a transfer medium and applies a voltage having an opposite polarity from the polarity of an electric charge of the toner image to electrostatically transfer the toner image on the transfer medium;

a paper feeding mechanism that feeds a sheet of paper as the transfer medium to the conductive roller;

a power supply device that applies a transfer bias voltage to the conductive roller including a voltage generating portion; and a resistance element connected between the voltage generating portion of the power supply device and the conductive roller in series, wherein, assuming that the value of resistance R0 of the resistance element is 1.0, a range of resistance of the synthetic value of resistance R of the transfer section connected to the resistance element in series is set as:

$$0.4 \leqq R \leqq 6.0.$$

7. An image forming apparatus comprising:

an image carrying member having a surface charged to a predetermined potential;

a latent image forming device that forms an electrostatic latent image on the surface of the image carrying member;

a developing device that develops the electrostatic latent image formed on the surface of the image carrying member to form a toner image;

an intermediate transfer medium;

a primary transfer section including a conductive roller for a primary transfer opposed with the toner image developed on the image carrying member via the intermediate transfer medium and applies a voltage having an opposite polarity from the polarity of an electric charge of the toner image to electrostatically transfer the toner image on the intermediate transfer medium;

a secondary transfer section including a conductive roller for a secondary transfer opposed with the toner image transferred to the intermediate transfer medium via a final transfer medium, and applies a voltage having an opposite polarity from the polarity of an electric charge of the toner image to electrostatically transfer the toner image to the final transfer medium;

a paper feeding mechanism for feeding a sheet of paper as the final transfer medium to the conductive roller for the secondary transfer;

a power supply device that applies a transfer bias voltage to either one or both of the conductive roller for the primary transfer and the conductive roller for the secondary transfer including a voltage generation portion; and a resistance element connected between the voltage generating portion of the power supply device and at least one of the conductive rollers for the primary and the secondary transfer in series, wherein, assuming that the value of resistance R0 of the resistance element is 1.0 a range of resistance of the synthetic value of resistance R of the transfer section connected to the resistance element in series is set as:

$$0.4 \leqq R \leqq 6.0.$$

* * * * *